109-83
9/20/77 XR 4,048,926

United States Patent [19]
Brush, Jr. et al.

[11] 4,048,926
[45] Sept. 20, 1977

[54] SAFE

[75] Inventors: John D. Brush, Jr.; George M. Burgess, both of Webster, N.Y.

[73] Assignee: John D. Brush & Co., Inc., Rochester, N.Y.

[21] Appl. No.: 648,504

[22] Filed: Jan. 12, 1976

Related U.S. Application Data

[63] Continuation-in-part of Ser. No. 588,967, June 20, 1975.

[51] Int. Cl.[2] ..... E05G 1/026
[52] U.S. Cl. ..... 109/65; 109/75; 109/83
[58] Field of Search ..... 109/27, 58, 59, 64, 109/65, 74, 75, 76, 77, 78, 80, 82, 83, 84; 70/208, 209, 210

[56] References Cited

U.S. PATENT DOCUMENTS

| | | | |
|---|---|---|---|
| 1,547,721 | 7/1925 | Bellamore | 109/65 |
| 1,895,594 | 1/1933 | Strandt | 70/210 |
| 2,492,422 | 12/1949 | Govan | 109/84 |
| 2,554,399 | 5/1951 | Bremer | 109/77 |
| 3,559,594 | 2/1971 | Miller | 109/84 |
| 3,855,741 | 12/1974 | Semon | 109/75 X |

FOREIGN PATENT DOCUMENTS

| | | | |
|---|---|---|---|
| 496,511 | 4/1930 | Germany | 109/27 |
| 153,998 | 11/1920 | United Kingdom | 109/83 |

*Primary Examiner*—Paul R. Gilliam
*Assistant Examiner*—David H. Corbin
*Attorney, Agent, or Firm*—Stonebraker, Shepard & Stephens

[57] ABSTRACT

A safe has a self-sealing jamb where the door confronts and fits together with the box. This is done by forming the confronting surfaces in the jamb region of a resin material and making the jamb region non-linear in cross section and long enough in cross section so that after an outer portion of the resin material is burned off in a fire, a charred residue and a plasticized portion of the resin material remain in the jamb region to seal the door to the box around the jamb region for substantially preventing heat conduction or passage of hot gasses through the jamb region to the interior of the box. The safe can also be formed in a resin mold for the box and the door with the mold remaining in place when the safe is used. The mold is preferably filled with a non-flammable, thermal insulating material having a substantial volume of chemically bonded water and made thick enough to maintain the interior of the box below 180° C for one hour in an ambient atmosphere of about 927° C. The box then lacks any external metallic shell so that the molded insulating material is exposed directly to the ambient atmosphere after the exterior resin casing is burned off in a fire. This also improves the heat resistance of the safe.

16 Claims, 7 Drawing Figures

SAFE

CROSS REFERENCE TO RELATED APPLICATION

This application is a continuation-in-part of our copending parent application, Ser. No. 588,967, filed June 20, 1975, entitled SAFE AND SAFE CONSTRUCTION METHOD.

BACKGROUND OF THE INVENTION

Safes, fire-proof file cabinets, and various fire resistant boxes and cabinets have consistently avoided use of materials that are flammable or unable to survive the high temperatures used in current fire-resistance tests. They have been made with external and internal steel shells filled with an insulating material so that the entire construction is formed of nonflammable materials. The external steel shell gives structural strength and protection and cooperates with the internal steel shell to support the insulation material and form a strong box or cabinet. Present insulation materials for fire-proof safes and cabinets are often moldable materials, and various mixes of concrete and other materials that contain a substantial volume of chemically bonded and free excess water are preferred. The construction of such safes and cabinets involves shaping and fitting together the parts of the steel shells, molding the insulation in place, and cleaning and finishing operations.

THE INVENTIVE IMPROVEMENT

The invention involves discovery of a way of making an automatic sealing jamb between the door and box of a fire-proof safe or cabinet by using a flammable resin material previously avoided in fire-proof constructions. The self-sealing jamb not only prevents hot gasses from leaking into the box during a fire, but also is thermally non-conductive for substantially improving fire resistance of a safe or cabinet otherwise conventionally constructed. Moreover, it effectively seals the door against accidentally springing open from a severe impact, as for example when the safe falls from an upper story to the basement of a burning building.

The invention also involves recognition of manufacturing problems and expense in using steel shells for fire-proof safes and cabinets, and these include: corrosion of the steel from moisture and chemicals in the insulation material; leakage of moisture from the insulation material into the interior of the safe or cabinet; cleaning, painting, and other finishing costs; susceptibility of the outer shell to being dented or marred; difficulty in securing a tight closure between the door and the box or cabinet; and the expense of fabricating and assembling steel shell parts.

The invention also includes the surprising discovery that molded insulation material not encased in a steel shell or other thermally conductive shell has far greater resistance to high temperatures and performs significantly better as an insulator against fire.

The recognition of the problems involving steel shells in fire-proof safes and cabinets, together with the discovery of a thermally non-conductive and self-sealing jamb and the improved performance of insulating material not surrounded by a steel shell, led to the inventive structure and construction method for making lighter-weight and better insulated safes and cabinets at lower cost and with greatly improved fire resistance for a significant advance in the art of making fire-proof safes and cabinets.

SUMMARY OF THE INVENTION

The invention applies to a safe with a box and a door having a jamb region where a peripheral region of the door confronts and fits together with a region around an opening in the box. The confronting surfaces of the door and box in the jamb region are formed of a resin material, and the jamb region is made non-linear in cross section and long enough in cross section so that after an outer portion of the resin material is burned off in a fire, a charred residue and a plasticized portion of the resin material remain in the jamb region to seal the door to the box around the jamb region for substantially preventing heat conduction or passage of hot gasses through the jamb region to the interior of the box. The external surfaces of the box and the door can be metal-clad in the conventional way, or can be further improved by eliminating the metal exterior. The box is then preferably formed of a molded, non-flammable, thermal insulating material having a substantial volume of chemically bonded water, and the material is thick enough to maintain the interior of the box below 180° C for one hour in an ambient atmosphere of about 927° C. The insulating material at the exterior surface of the box is substantially exposed directly to ambient atmosphere at temperatures of about 927° C. The insulating material is preferably a foamed concrete containing substantial water in excess of the chemically bonded water, and the concrete is preferably reinforced with a woven wire element or strands of reinforcing material, and preferably contains an aggregate holding absorbed water in excess of the chemically bonded water.

One preferred construction for the inventive safe includes resin inner and outer shells forming a mold cavity in which the box is cast and another resin shell in which the cover or door is molded. The resin on exterior surfaces of the safe is burned off at temperatures below 927° C, but resin material in the jamb region between the door and the box is plasticized by heat to seal the door to the box and make the jamb region substantially thermally non-conductive at temperatures of about 927° C.

The inventive safe construction method includes molding inner and outer mold parts of resin material to enclose a box-shaped cavity between the mold parts. The cavity is then filled with a moldable, non-flammable, thermal insulating material having a substantial volume of chemically bonded water which sets to form an open-ended box thick enough to maintain the interior of the box below 180° C for 1 hour in an ambient atmosphere of about 927° C. The molded insulating material is then left in the mold parts for use as a safe, with the insulating material at the exterior surfaces of the box being substantially exposed directly to ambient atmosphere at temperatures of about 927° C. The door for the box is also preferably molded of insulating material cast in a resin mold shell.

DETAILED DESCRIPTION OF THE INVENTION

Figure 1:
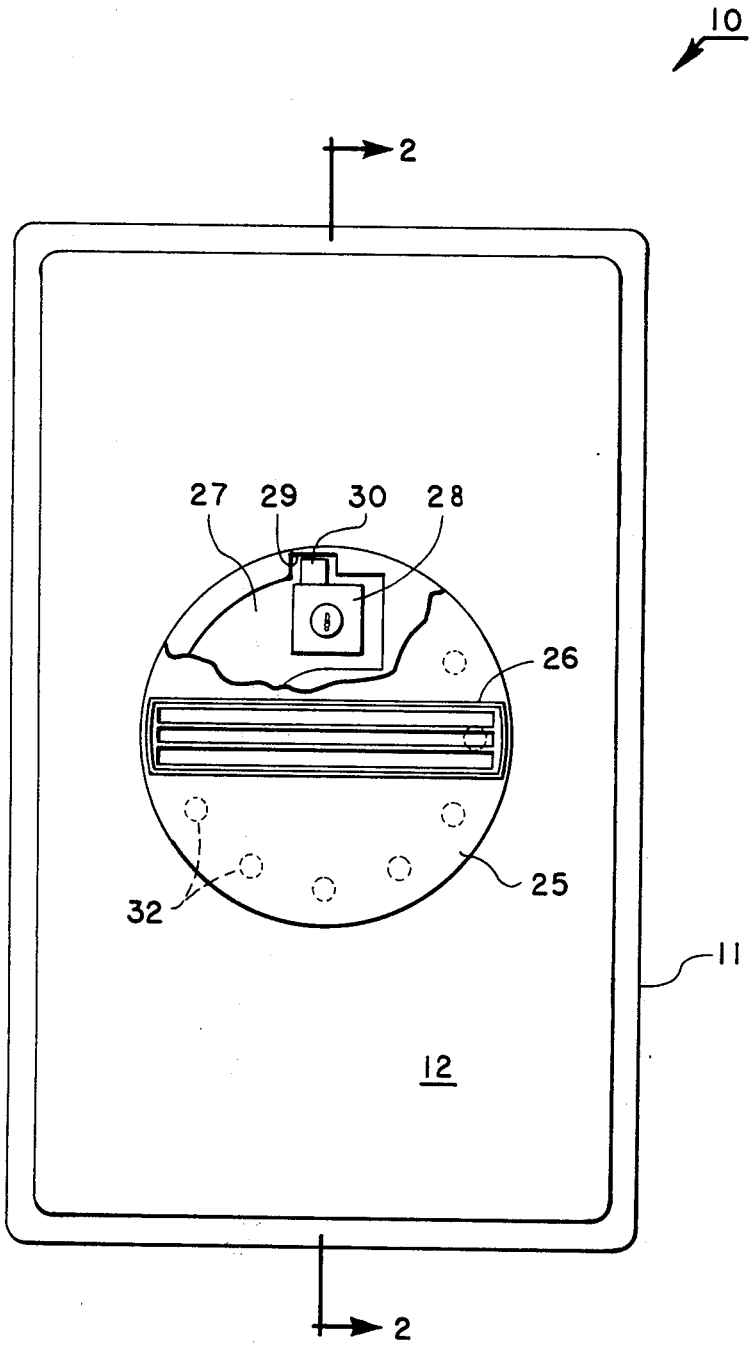
FIG. 1 is a partially cut-away, front end elevational view of a preferred embodiment of the inventive safe.
Figure 2:
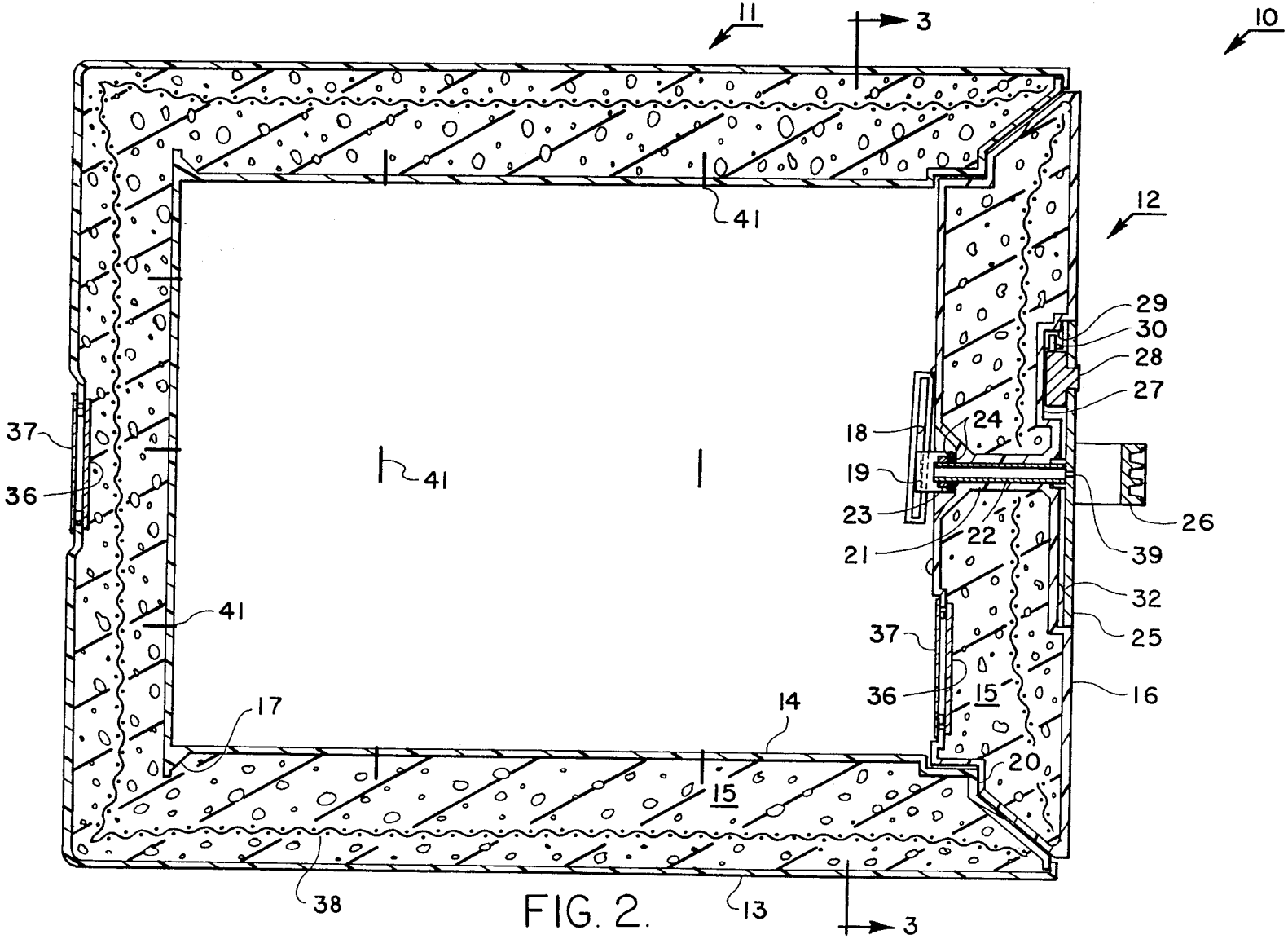
FIG. 2 is a longitudinal cross-sectional view of the safe of FIG. 1, taken along the line 2—2 thereof.

One major discovery of the invention is that omission of the outer steel shell normally used for fire-proof safes and cabinets leads to surprisingly improved fire resistance for the insulation material exposed directly to a hot ambient atmosphere without the supposed protection of an outer steel shell. The molded insulating material then provides the necessary structural strength, either by itself or with the help of reinforcing materials, and with its improved insulating capacity, allows smaller and lighter safes and cabinets to perform substantially better in fire tests. Various insulating and reinforcing materials can be used, and the omission of a steel outer shell then leads to many manufacturing advantages, reduction of costs and waste, simplicity of construction, and a surprisingly better product at a significantly lower cost.

Another major discovery of the invention is a way to make a thermally non-conductive and automatically sealing jamb between the door and the box of a fire-proof safe or cabinet by forming the confronting surfaces of the jamb region of resin material. The jamb region is also made non-linear in cross section and with the mating surfaces long enough in cross section so that after an outer portion of the resin material is burned off in a fire, a charred residue and a plasticized portion of the resin material remain in the jamb region to seal the door to the box around the jamb region for substantially preventing heat conduction or passage of hot gasses through the jamb region to the interior of the box.

One preferred embodiment of the invention as applied to a relatively small safe will be described first, the preferred construction methods and materials will be explained, and the resin-surfaced jamb will be described as applied to any fire-proof safe or cabinet.

The safe 10 includes an open-ended box 11 and a removable cover or door 12 for covering the opening in the box 11 to form a tight enclosure for valuable papers and objects. The box 11 includes an outer shell 13 and an inner shell 14, each preferably formed of molded resin material and fitted together in the region of the door 12. The space between the outer shell 13 and the inner shell 14 is filled with a molded insulating material 15. The door 12 has a molded resin shell 16 preferably filled with more of the same insulating material 15 used in the box 11.

The inner shell 14 has tabs 17 formed to extend outward into the insulating material 15 to provide an interlock preventing the inner shell 14 from moving relative to the insulation material 15. The inner shell 14 also has an opposed pair of locking slots 18 that are preferably slanted as illustrated for receiving the ends of a locking bar 19 on the door 12. The inner shell 14 and the door shell 16 have a step or other irregularity 20 in the jamb region between the box 11 and the door 12 so there is no straight passageway from the inside to the outside of the safe 10 between the box 11 and the door 12.

The resin shell 16 for the door 12 preferably has a molded resin bushing 21 providing an opening through the door 12. A handle tube 22 extends through the bushing 21 and supports the locking bar 19 on the one end of the tube 22 where the locking bar 19 is arranged between retainer washers 24 and held in place by a retainer nut 23. A disk 25 is secured to the outer end of the handle tube 22, and a handle 26 is secured to the disk 25 so that the handle 26, the disk 25, the tube 22, and the locking bar 19 are all rotatable together through an arc for locking and unlocking the safe 10.

Figure 3:
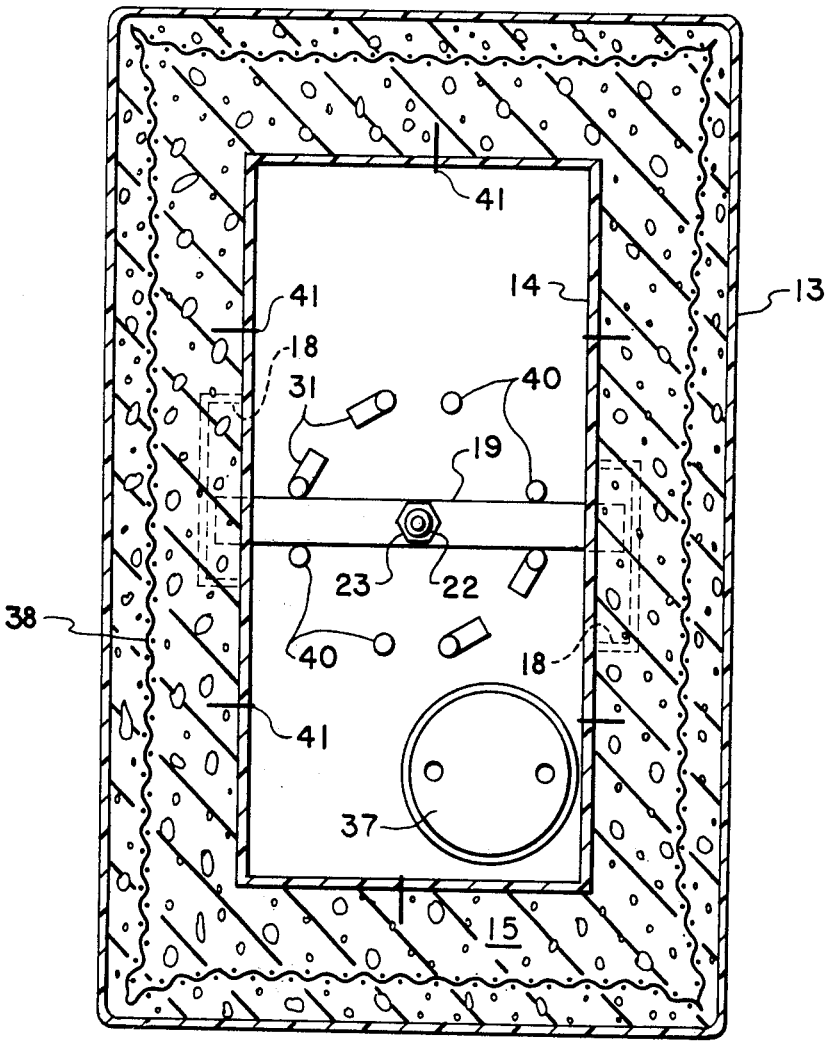
FIG. 3 is a cross-sectional view of the safe of FIG. 2, taken along the line 3—3 thereof.
Figure 4:
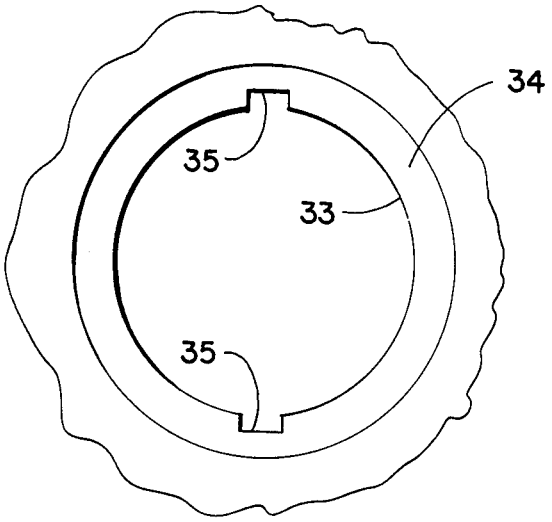
FIG. 4 is a fragmentary plan view of a filler opening for the box and the cover for the safe of FIGS. 1–3.
Figure 5:
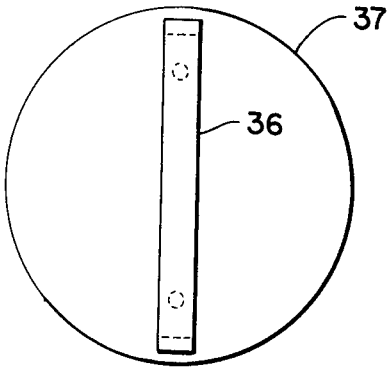
FIG. 5 is a plan view of a closure cap for the filler opening of FIG. 4.

The resin shell 16 at the exterior of the door 12 is formed with an arc-shaped recess 27, and a lock 28 secured to the underside of the door disk 25 moves in the recess 27 as the door 12 is locked and unlocked. The recess 27 has an enlargement 29 for receiving the bolt 30 of the lock 28 to retain the disk 25, the handle 26, and the lock bar 19 in locking position with the ends of the lock bar 19 held in the locking slots 18 in the inner shell 14 of the box 11, as best shown in FIG. 3.

The interior of the door 12 preferably has a set of stop detents 40 and ramp detents 31 for detenting locking bar 19 firmly in both locked and unlocked positions. This helps the user be aware of full lock and unlock positions so that the user does not accidentally pick up the safe 10 with the handle 26 in an unlocked or partially locked position and have the box 11 drop off the door 12. The door 12 also has one or more projections 32 under the handle disk 25 to provide bearing surfaces during rotation of the disk 25. A small hole 39 in the door disk 25 provides a vent passageway through the tube 22 for venting gasses from the interior of the safe 10.

The external shell 13, preferably at the bottom or the back of the box 11, and the internal surface of the door shell 16 each preferably have a die-cut opening 33 formed within a recess 34 where the insulating material 15 is poured into the box 11 and the door 12. The openings 33 have notches 35 that receive the ends of a cross piece 36 on a closure cap 37 that is inserted into the notches 35 and turned to close the cavities in the box 11 and the door 12 after filling the cavities with the insulation material 15.

In the illustrated embodiment of the safe 10, the outer shell 13, the inner shell 14, and the door shell 16, all serve as mold parts for casting the insulation material 15 in the proper shape. Since the shells 13, 14, and 16 are all preferably formed of resin material, the resin on the exterior of the safe 10 is quickly burned away in a fire to leave the insulating material 15 directly exposed to the hot ambient atmosphere. This substantially improves the insulating capacity of the material 15, and although the reasons for this are not yet certain, one possibility is that moisture driven off from the insulating material 15 forms a thin barrier shield against the high ambient temperatures to help protect the insulating material 15 from the more intense heat a short distance away. For whatever reason, the insulating capacity of the material 15 without any thermally conductive outer shell is surprisingly increased, and the material 15 does a better job of keeping temperatures low inside of the safe 10.

The insulating material 15 can be removed from the mold shells 13, 14, and 16, or any other mold cavity forming the insulating material 15, and can be used without any of the shells 13, 14, or 16 being in place. For example, the box 11 and the door 12 can each be molded directly of insulating material 15 in automatic molding equipment, and the castings for the box 11 and the door 12 can be dipped in a sealing and finishing material, the jamb regions covered with a resin material, and the door provided with a handle and locking bar assembly for use directly as safes. In the illustrated embodiment, the shells 13, 14, and 16 serve as expendable molds for the body 11 and the door 12 and serve several other functions in the completed assembly.

The shells 13, 14, and 16 can be formed of a variety of resinous materials such as polyethylene, polyvinylchloride, and many other moldable thermoplastic materials. They can be injection molded, blow molded, or vacuum formed in generally known ways, can be made in single pieces, or can be made as separate parts fitted together. For example, the inner shell 14 can be blow molded integrally with outer shell 13, and the two shell parts cut apart at a junction line so they snap-fit together to form a cavity for the insulating material 15. The door shell 16 is also preferably blow molded in a single piece with the bushing 21 for the handle tube 22 being formed integrally with the shell 16.

The insulating material 15, in addition to being moldable and non-flammable, preferably includes a substantial volume of chemically bonded water. Various concrete mixes can accomplish this, and generally the more water the mix can contain without separating, the better insulator results from the material 15. Also, to lighten the weight and improve the performance of the insulating material 15, a concrete or other molded material forming the insulator 15 is preferably foamed to produce relatively small and accurately controlled and distributed closed-cell bubbles. Then the mix is preferably given more water than can form a chemical bond with the cement or can be absorbed by any aggregate, and the excess water is stored in the pores of the foamed casting. One preferred mix is 10 parts water to 10 parts pure Portland cement, type I, with the addition of a foaming agent and up to 10% by weight of a water-absorbing aggregate, such as vermiculite, grade 3, or pearlite, medium grade. Thorough mixing is preferred to disperse the water uniformly throughout the mix so that the excess water and the other materials do not separate as the casting is made. Pure Portland cement is preferred for a concrete mix because of its capacity to form a chemical bond with a relatively large volume of water, and water-absorbing aggregates can be used for additional fire protection. The foaming of the concrete not only lightens its weight and enhances its capacity to retain moisture, but also the concrete is less likely to fracture in a drop test, and tends to crush locally as bubble cells are broken, so that a foamed concrete insulating material 15 provides a stronger and better safe.

Insulating material 15 is also preferably reinforced to improve its structural strength, and preferred reinforcing materials include a woven wire element 38 such as a hardware cloth or chicken wire or other wire mesh preferably arranged well inward from the exterior of the box 11. This keeps the reinforcing wire material 38 away from the highest temperature regions so that the reinforcing element 38 is protected from heat and is better able to preserve the strength of the insulating material 15.

Other reinforcing materials for the insulating material 15 preferably include fibrous strands such as steel wool, resin fibers such as nylon or rayon, resin-encased or concrete-resistant glass fibers and other fibers such as resinous fibers currently being used in automobile tires. Such fibers are preferably mixed uniformly throughout insulating material 15.

Direct casting of the box 11 and the door 12 in automatic casting equipment, followed by dip or spray coating with a sealant and finishing material and application of resin material to the jamb regions is preferred for the economies possible in high-volume production. For somewhat lower volume, the safe 10 is preferably made by blow molding or injection molding the shells 13, 14, and 16, cutting out the filler openings 33, and fitting any shell parts together to form expendable mold cavities for the body 11 and the door 12. These are then filled with the insulating material 15, and the filler openings are closed by the caps 37 that are manually inserted into the openings 33 and turned a few degrees. Any spilled concrete is merely wiped up with a damp cloth, and the body 11 and the door 12 are allowed to rest without agitation for long enough to set insulating material 15. Then the handle and the locking bar are assembled in the door 12, preferably by preassembling the handle 26, the handle plate 25, the lock 28, and the tube 22, which is inserted through the bushing 21, so that the lock bar 19 and the retainer washers 24 can be secured in place with the retainer nut 23. The shells 13, 14, and 16 then directly provide a protective exterior finish that cannot be dented and is not easily marred, and the assembly of the safe 10 is complete without any of the cleaning or painting operations necessary for steel-shelled safes. The shells 13, 14, and 16 are also made very simply and cheaply, and assembly costs are small, so that the inventive safe is far cheaper than a steel safe. Also, the shells 13, 14, and 16 completely seal the insulation material 15 so no moisture can leak into the interior of the box 11, as often occurs with steel safes.

Instead of interlocks 17, fasteners such as staples 41 can be driven through inner shell 14 and into the insulation material 15, preferably after the material 15 has set. The staples 41 are easy to apply and not only prevent movement of the shell 14 relative to material 15, but hold the shell 14 in place against any steam pressure tending to collapse the shell 14 inward while it is softened by heat.

Before describing the operation of the safe 10 in a fire, several standard tests for safes and fire-proof cabinets will be described. To be certified as a fire-proof device, a box or cabinet must pass two tests. One test is to place a room-temperature safe in an oven preheated to 2,000° F (about 1093° C) for ½ hour and then remove the safe to room temperature as a heat stress test. The other test is to place the safe in an oven that is gradually heated to 1700° F (about 927° C) for 1 hour while monitoring the internal temperature of the safe, which must not exceed 350° F (about 177° C). For a higher level of certification, a safe must not only pass these two tests, but also pass an additional test which is to heat the safe up to 1550° F (about 843° C) for ½ hour, then remove and drop the hot safe about 9 meters, and return the dropped safe to its previous temperature for another ½ hour. These tests simulate various conditions that safes can encounter in fires, and the temperatures used to define the invention are related to the present test temperature as one convenient indication of the fire proofing the invention accomplishes. If the test temperatures are lowered in the future, then corresponding reductions in the temperatures used to define the invention should be made, because the recited temperatures are pertinent only to existing tests.

In any of these tests, or in an actual fire of comparable heat, the external shell 13, and the exterior of the door shell 16 quickly burn away and leave the insulating material 15 exposed directly to the hot ambient atmosphere. The exterior of the insulating material 15 is calcined, and the moisture it contains is driven off from the region of its external surface. The moisture trapped deeper within the insulating material 15 forms a heat sink, and the lack of thermal conductivity through the insulating material 15 prevents the hot ambient atmosphere from heating up the inside of the safe 10. The capacity of the insulating material 15 to resist the surrounding heat is greatly enhanced by lack of any steel outer shell as explained above.

The resin material in the jamb region between the door 12 and the body 11 improves substantially over prior art metallic constructions by being substantially thermally non-conductive so that heat from the hot exterior of the safe during a fire is not conducted through the jamb region to the interior of the safe. During a fire, the resin material is burned away at the exterior of the jamb to leave a charred residue or ash that remains along a char line extending around the jamb region between the exterior and the interior of the safe. Just inside the char line the resin material is plasticized by heat to fuse together the resin of the door shell 16 and the inner box shell 14 to form a seal in the region of the step 20. This is sufficiently inward from the exterior of the safe 10 so that the sealed resin remains soft but is not sufficiently heated to be burned away. The resin material thus forms an automatic door seal preventing entry of hot gasses into the interior of the box 11, and the automatic fusing and sealing of the door 12 to the box 11 by the bond between the resin shells 14 and 16 is superior to any seal achievable in the jamb region of a steel box and a steel door. Furthermore, the charred residue of resin material along the char line, and the plasticized seal of resin material, are both thermally nonconductive to preclude any conductive path for heat from the exterior to the interior of the safe 10. Many different irregularities in the jamb region between the door 12 and the box 11 can be used to provide a well or a collecting ring to insure a fused seal between the resin of the door shell and the box shell, and other self-sealing jambs are explained more fully below as applied to other safes.

To prevent any buildup of gas pressure inside the safe 10, the small breather hole 39 in the door plate 25 allows gas to escape through the door 12 without requiring blowout plugs or other more complex and expensive devices.

Experience with the invention has shown that relatively small safes can be made to pass tests previously achieved only by much larger safes. The invention also eliminates much equipment and labor previously involved in shaping and assembling steel parts, sandblasting and cleaning steel safes after the insulation is poured, and painting and finishing steel safes, and the invention eliminates waste from dented and marred steel safes. Hinges can be eliminated, and the simple lock bar, lock, and handle assembly made possible by molding the door is more economical than anything achievable in a steel-shelled safe. Also, the inventive safe is lighter and more readily carried home by purchasers and can be sold for less than a steel safe of the same size.

Figure 6:
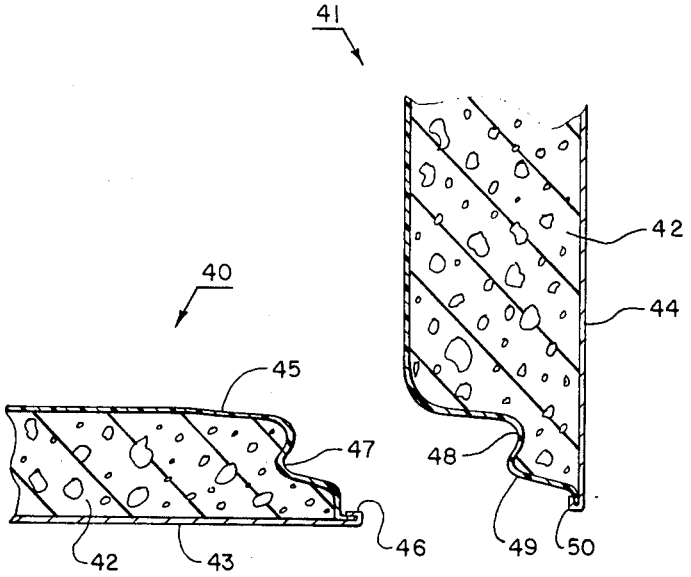
FIGS. 6 and 7 are fragmentary, cross-sectional views of other preferred embodiments of the invention using automatically sealing jambs.
Figure 7:
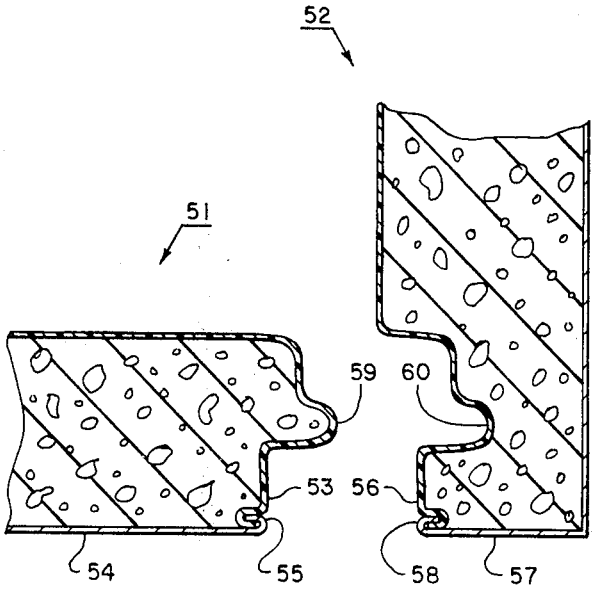

Experience with the invention has also shown that the self-sealing jamb made of resin material substantially improves the fire resistance of a safe or cabinet otherwise constructed in a conventional way, and FIGS. 6 and 7 show two examples of the application of this aspect of the invention to safes. The safe of FIG. 6 has an open-ended box 40 and a door 41, each filled with a molded thermal insulating material such as foamed concrete 42 as explained above. The exterior of the box 40 is formed as a conventional steel shell 43, and the exterior of the door 41 is also formed of a steel structure 44. Door hinges, locks, handles, wheels, and styling structures can all be applied as is generally known.

The difference in the safe of FIG. 6 is formation of the jamb region between the box 40 and the door 41 of a resin material that is preferably molded. For the box 40, this is preferably done by forming a molded resin box liner 45 joined to the outer shell 43 in an interlock 46 and extending not only through the jamb region around the opening of the box 40, but also forming the inner liner for the box 40. Alternatively, the liner for the box 40 can also be formed of steel, with the resin piece 45 interlocked with both the outer shell 43 and the metal inner liner to extend only through the jamb region. As illustrated, the jamb region of the box 40 is formed with an S curve 47 fitting closely with a corresponding S curve 48 in the door 41. The inner face of the door 41 is preferably formed of a molded resin piece 49 secured to the outer door shell 44 by an interlock 50. Again, the resin piece 49 can extend only through the jamb region of S curve 48 to interlock with a metallic inner wall for the door 41. Also, interlocks or attachments joining the resin pieces 45 and 49 to the metallic parts 43 and 44 can be accomplished in various ways, as is generally known in the art.

The mating S curves 47 and 48 between the box 40 and the door 41, and the cross-sectional length of the jamb region from the exterior to the interior of the safe of FIG. 6 insure that before all the resin in the jamb region is burned away by the heat of a fire, plasticized resin will remain in the jamb region to fuse the resin pieces 45 and 49 together for automatically sealing the door 41 to the box 40. Also, the elimination of thermally conductive metal in the jamb region and use of resin pieces 45 and 49 makes the jamb region thermally nonconductive, and heat is not conducted through the charred residue of resin or the plasticized resin seal.

The safe of FIG. 7 is similar to the safe of FIG. 6, except for a different configuration of the jamb region between the box 51 and the door 52. A resin piece 53 joined to the outer box shell 54 at an interlock 55 extends through the jamb region of the box 51 and preferably also forms a resin inner liner for the box 51, and a resin piece 56 joined to the outer shell 57 of the door 52 in an interlock 58 also extends through the jamb region and preferably forms the inner surface of the door 52. The differences from the safe of FIG. 6 are a jamb region formed with a double-step ridge 59 on the box 51, and a corresponding double-step groove 60 on the door 52. Again, the jamb configuration is both non-linear in cross section and of sufficient length in cross section from the outside to the inside of the safe so that the char line occurs within the jamb region and plasticized plasticized resin from the pieces 53 and 56 fuses together in a fire for automatically sealing the door 52 to the box 51. Also, the residue ash at the char line from the burned-away resin material, and the plasticized and fused resin material forming the seal, are both thermally non-conductive for a substantial improvement over metallic jambs.

Many other jamb configurations, resin and metal part shapes, and interlocks between resin and metallic parts are possible in forming self-sealing jambs according to the invention. Furthermore, wherever practical relative to other considerations, outer metallic shells are preferably eliminated as described above for further enhancement of the fire resistance of the safe.

Those skilled in the art will appreciate the many sizes and shapes that can be used in applying the invention to safes, cabinets, and other fire-proof structures. They will also recognize ways that various molding and assembly processes can be applied with different materials in practicing the invention.

What is claimed is:

1. A fire-resistant safe for protecting stored contents from ambient fire, said safe having a box and a door formed of a thermal insulating material and having a jamb region that is non-linear in cross section where a peripheral region of said door confronts and fits together with a region around an opening in said box, and said safe comprising:

a. the space between said insulating material of said box and said door in said jamb region being substantially filled with a resin material overlying said insulating material, said resin material being combustable at temperatures substantially less than the temperature of said ambient fire;

b. said resin material being substantially thermally non-conductive and arranged to provide means for substantially preventing conduction of heat from said ambient fire through said jamb region to the interior of said box;

c. said space between said insulating material of said box and said door in said jamb region being thin enough relative to the length of said non-linear cross section to provide means for protecting an inner portion of said resin material in said jamb region from combustion in said ambient fire; and d. said resin material providing means for substantially sealing said jamb region against passage of hot gases from said ambient fire into said interior of said box, said sealing resulting from a charred resin residue adjacent said unburned inner portion of said resin material after said ambient fire burns away an outer portion of said resin material.

2. The safe of claim 1 wherein said resin material is formed in two layers respectively overlying said insulation material of said box and said door.

3. The safe of claim 1 wherein said resin material is thermoplastic.

4. The safe of claim 1 wherein said resin material overlies the exterior surfaces of said box where said resin is burnable at temperatures less than said temperature of said ambient fire.

5. The safe of claim 1 wherein said resin material forms a liner for said interior of said box.

6. The safe of claim 5 wherein said resin material overlies the exterior surfaces of said box where said resin is burnable at temperatures less than said temperature of said ambient fire.

7. The safe of claim 1 wherein said resin material overlies inner and outer surfaces of said box and said door.

8. The safe of claim 7 including a handle rotatable relative to said door, a tube extending through said door and rotatable with said handle, a lock bar mounted on said tube inside said door and rotatable with said tube, and recesses in the interior of said box for receiving the ends of said lock bar in a locked position of said door.

9. The safe of claim 8 including a bushing formed of said resin material to extend around said tube.

10. The safe of claim 8 wherein said door has an opening extending through said tube to vent the interior of said box.

11. The safe of claim 8 wherein said door has an arc-shaped recess, a lock pivots with said handle in said recess, said recess includes an enlargement area in the region of one end of said arc shape, and said lock has a bolt removably extendable into said enlargement area to hold said handle and said lock bar in said locked position.

12. The safe of claim 11 including a disk movable with said handle and said tube and overlying said recess.

13. The safe of claim 1 including a handle rotatable relative to said door, a tube extending through said door and rotatable with said handle, a lock bar mounted on said tube inside said door and rotatable with said tube, and recesses in the interior of said box for receiving the ends of said lock bar in a locked position of said door.

14. The safe of claim 13 wherein said door has an arc-shaped recess, a lock pivots with said handle in said recess, said recess includes an enlargement area in the region of one end of said arc shape, and said lock has a bolt removably extendable into said enlargement area to hold said handle and said lock bar in said locked position.

15. The safe of claim 14 including a disk movable with said handle and said tube and overlying said recess.

16. The safe of claim 15 wherein said door has an opening extending through said tube to vent the interior of said box.

* * * * *